US011753886B2

(12) United States Patent
Vick, Jr. et al.

(10) Patent No.: US 11,753,886 B2
(45) Date of Patent: Sep. 12, 2023

(54) EXPANDABLE METAL PACKING STACKS

(71) Applicant: HALLIBURTON ENERGY SERVICES, INC., Houston, TX (US)

(72) Inventors: James Dan Vick, Jr., Dallas, TX (US); Stephen Michael Greci, Little Elm, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 442 days.

(21) Appl. No.: 17/051,762

(22) PCT Filed: Nov. 14, 2019

(86) PCT No.: PCT/US2019/061526
§ 371 (c)(1),
(2) Date: Oct. 29, 2020

(87) PCT Pub. No.: WO2021/096519
PCT Pub. Date: May 20, 2021

(65) Prior Publication Data

US 2023/0017192 A1 Jan. 19, 2023

(51) Int. Cl.
*E21B 23/02* (2006.01)
*E21B 23/06* (2006.01)
*E21B 33/127* (2006.01)

(52) U.S. Cl.
CPC ..... *E21B 23/02* (2013.01); *E21B 23/06* (2013.01); *E21B 33/127* (2013.01)

(58) Field of Classification Search
CPC ..... E21B 23/02; E21B 23/06; E21B 33/127
See application file for complete search history.

(56) References Cited

U.S. PATENT DOCUMENTS 3,856,081 A * 12/1974 Canalizo ..... E21B 33/129 166/123
4,811,959 A 3/1989 Bullard et al.
(Continued)

FOREIGN PATENT DOCUMENTS

WO WO-2016171666 A1 10/2016
WO WO-2019094044 A1 5/2019
(Continued)

OTHER PUBLICATIONS

Korean Intellectual Property Office, International Search Report and Written Opinion, dated Aug. 11, 2020, 13 pages, Korea.

*Primary Examiner* — Yong-Suk (Philip) Ro
(74) *Attorney, Agent, or Firm* — Scott Richardson; C. Tumey Law Group, PLLC

(57) ABSTRACT

Seal elements for establishing fluid seals in a wellbore may be constructed of expandable metal materials. For example, an elongated gland of expandable metal may replace some or all the components in a packing stack of a locking mandrel. The gland may be recessed within the locking mandrel, or narrower than a seal bore of a landing nipple, such that the gland is protected from damage as the locking mandrel passes through landing nipples to reach a target landing nipple. The expandable metal may be induced to chemically react with a brine or other water-based fluid to form metal hydroxides and may thus create a seal with the target landing nipple. Once an intended purpose of the locking mandrel has been achieved, a pressure reversal may be employed to break the seal and/or a mild acid may be introduced to accelerate dissolving of the expandable metal seal.

20 Claims, 4 Drawing Sheets

(56) References Cited

U.S. PATENT DOCUMENTS

| | | | | |
|---|---|---|---|---|
| 11,299,955 | B2 * | 4/2022 | Fripp | E21B 33/1208 |
| 11,421,505 | B2 * | 8/2022 | Pelto | E21B 33/127 |
| 11,560,768 | B2 * | 1/2023 | Fripp | E21B 33/1212 |
| 2016/0137912 | A1 | 5/2016 | Sherman et al. | |

FOREIGN PATENT DOCUMENTS

| | | | |
|---|---|---|---|
| WO | WO-2019164492 | A1 | 8/2019 |
| WO | WO-2019164499 | A1 | 8/2019 |
| WO | WO-2020018110 | A1 | 1/2020 |

* cited by examiner

EXPANDABLE METAL PACKING STACKS

CROSS-REFERENCE TO RELATED APPLICATIONS

This application is a U.S. national stage patent application of International Patent Application No. PCT/US2019/061526, filed on Nov. 14, 2019, the benefit of which is claimed and the disclosure of which is incorporated herein by reference in its entirety.

BACKGROUND

The present disclosure relates generally to equipment and operations for use in a subterranean wellbore. Example embodiments described herein include locking mandrels used to anchor wellbore tools at downhole locations, and fluid seals for the locking mandrels that contain expandable materials.

Wellbore systems may include multiple segments of metal tubing, valves, connectors and other components that are coupled to one another to form a tubular string. The tubular string may be installed in a wellbore for the production of hydrocarbons or to facilitate other wellbore operations. To support these wellbore operations, wellbore tools may be releasably anchored at various downhole locations within the tubular string with a locking mandrel.

Often a packing stack is provided on the exterior of a locking mandrel to form a fluid barrier with a tubular string surrounding the locking mandrel. The packing stacks may include an o-ring seal provided between chevron-shaped packing rings and backup rings of any number, shape, material style and placement. Damage to the elastomeric o-ring seal or other portions of the packing stack may occur as the locking mandrel is installed in the wellbore. For example, the packing stack may be scratched by interior surfaces of the tubular string, or by traversing multiple nipple bores as the mandrel is lowered into the wellbore. Contact with the tubular string may cause the packing rings to prematurely load adjacent packing rings, which could result in a low-quality seal or other otherwise inhibit performance of the packing stacks.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes establishing seals between wellbore components, e.g., between adjacent wellbore tubulars, with seal elements constructed of expandable metal materials. An elongated gland of expandable metal may replace some or all the components in a packing stack of a locking mandrel. The gland may be recessed within the locking mandrel, or narrower than a seal bore of a landing nipple, such that the gland is protected from damage as the locking mandrel passes through landing nipples to reach its intended destination in the wellbore. After a short time in the wellbore, the expandable metal may be induced to chemically react in the presence of brine or another water-based fluid to form metal hydroxides, and may thus create a seal. After a pressure test, the intended purpose of the locking mandrel and/or a wellbore tool coupled thereto may be carried out. To break the seal, a pressure reversal may be employed, and the lock mandrel may be retrieved, or an acid may be introduced to accelerate dissolving of the expandable metal seal.

Advantageously, seal elements constructed of expandable metals may be used on roughly finished surfaces, corroded surfaces, or 3-D printed parts. Yet a further advantage is that the expandable metals may swell in high-salinity and/or high-temperature environments where the use of elastomeric materials, such as rubber, can perform poorly. The expandable metal sealing elements may be used as replacements for other types of sealing mechanism typically employed on a locking mandrel, e.g., complete packing stacks or individual sealing elements within the packing stacks.

Figure 1:
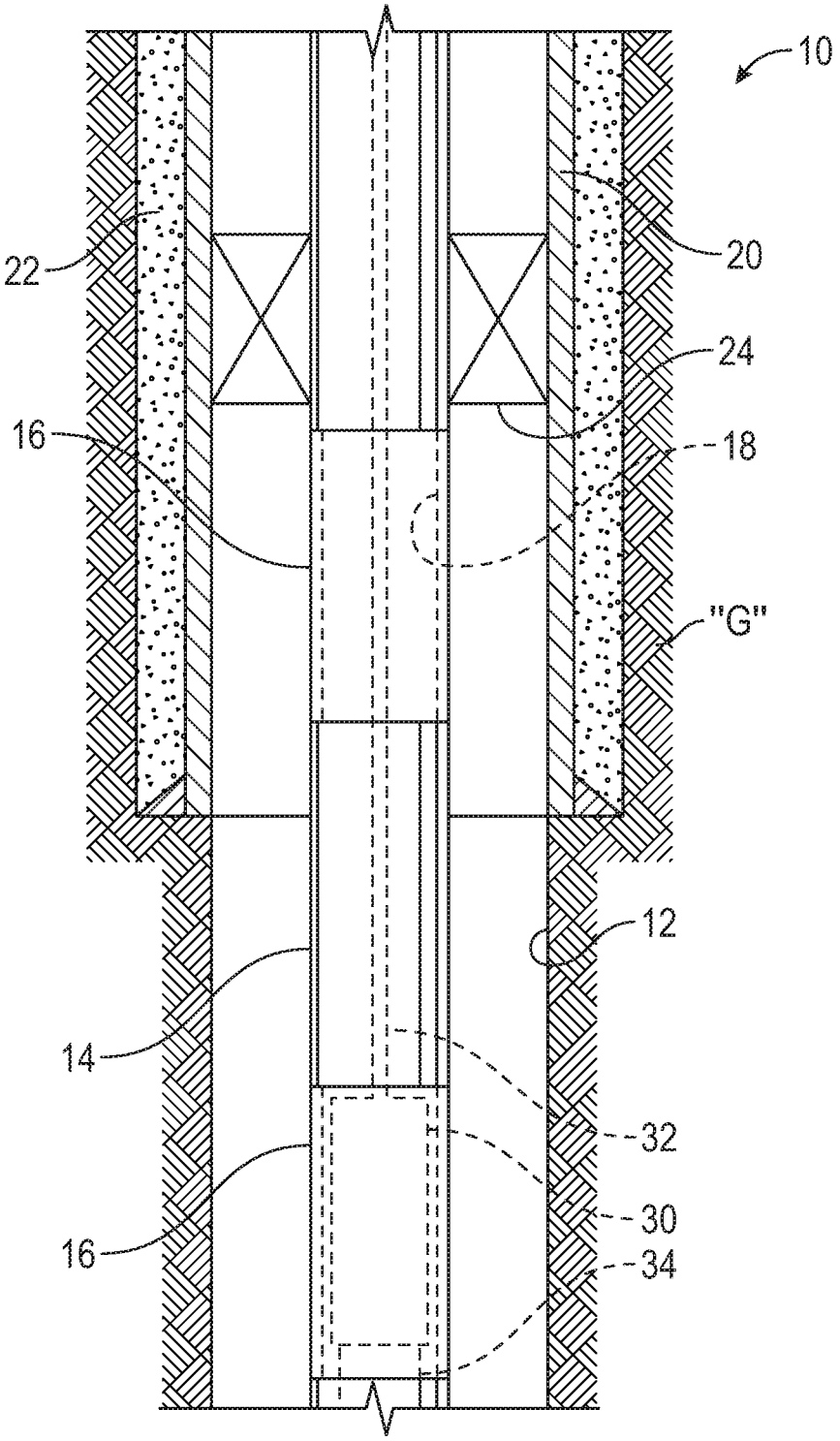
FIG. 1 is a partial, cross-sectional side view of a wellbore system including a plurality of landing nipples installed in a tubular string for receiving a locking mandrel in accordance with principles of the present disclosure.

Referring to FIG. 1, an exemplary embodiment of a wellbore system 10 includes a wellbore 12 extending through a geologic formation "G." As illustrated, the wellbore 12 is generally vertical, and other orientations, e.g., horizontal, angled, branched, etc. are also contemplated. A tubular string 14 is installed in the wellbore 12 and includes a plurality of landing nipples 16 coupled therein. As illustrated, the tubular string 14 may be characterized as a production tubing string, and in other embodiments, the tubular string 14 could be a liner string, casing string or any other tubular string having an interior passageway 18 extending therethrough. Wellbore 12 may be fully or partially cased. As illustrated, a casing string 20 is deployed in an upper portion of the wellbore and secured in place with cement 22. A lower portion of the wellbore 12 below the casing string 20 is generally encased. An annular barrier is formed between tubular string 14 and casing string 20 by a packer element 24, and in other embodiments another annular barrier (not shown) may be formed between tubular string 14 and the geologic formation "G:"

A locking mandrel 30 may be lowered through the interior passageway 18 of the tubular string 14 with a conveyance 32 such as a wireline, slickline, coiled tubing, or another tubular string. The locking mandrel 30 may traverse one or more landing nipples 16 before arriving at an intended location in the wellbore 12 where the locking mandrel 30 may be employed to lock a wellbore tool 34 in place. The wellbore tool 34 may include an equalizing valve, or any other equipment useful in the particular tubular string 14.

The landing nipples 16 may be arranged in the tubular string 14 in a variety of different configurations. For example, the landing nipples 16 may be arranged as a staggered bore completion in which a sealing bore or sealing surface 40 (FIG. 2) may be graduated or tapered, or in a selective bore completion in which the sealing bore or sealing surface 40 is generally straight. A staggered bore arrangement may be characterized, e.g., by a plurality of landing nipples 16 arranged such that each individual landing nipple 16 defines an inner diameter $ID_1$ (FIG. 2) that is smaller than an inner diameter of each landing nipple 16 disposed above the individual landing nipple 16 in the tubular string 14. In a selective bore arrangement, each landing nipple 16 may define an inner diameter $ID_1$ that substantially similar along the tubular string. In some embodiments, a combination of both staggered and selective landing nipples may be employed. For example, stagger bore nipples could be employed at a wellhead and safety valve (not shown and selective bore nipples could be deployed deep within the wellbore.

Figure 2:
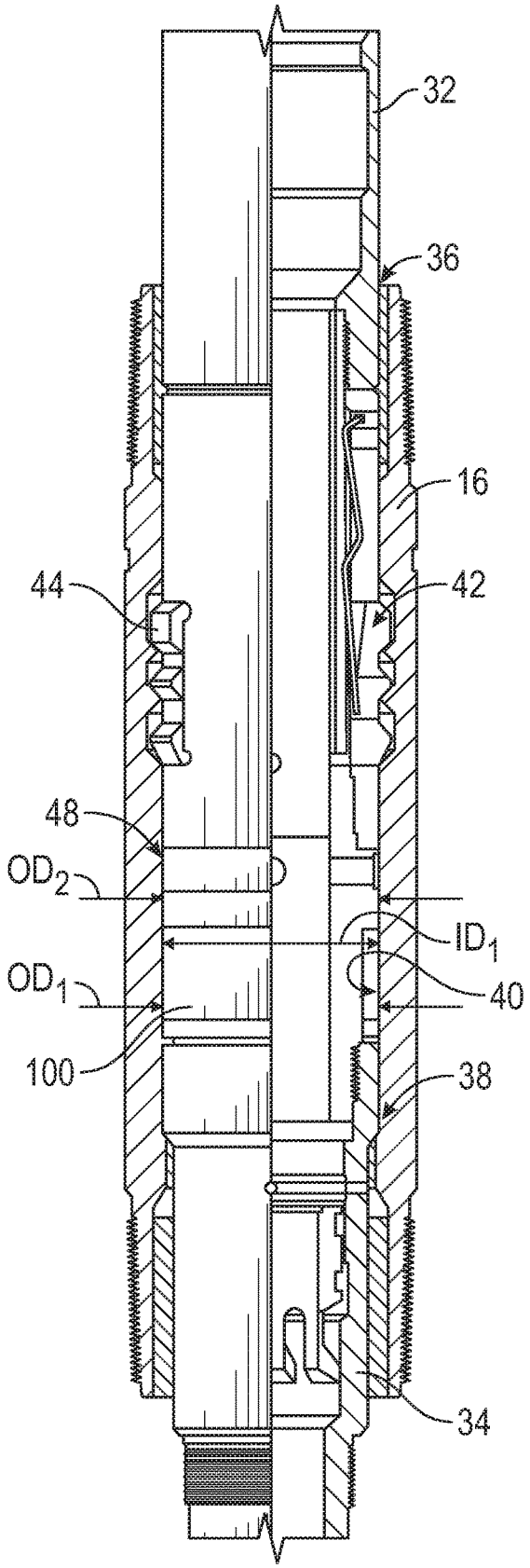
FIG. 2 is a cross-sectional view of the locking mandrel inserted into one the landing nipples of FIG. 1 illustrating a single-element, "expandable metal" or "swell metal" packing installed on the locking mandrel.

Referring to FIG. 2, a landing nipple 16 is illustrated with a locking mandrel 30 installed therein. The locking mandrel 30 includes elongated body receivable in an internal bore 36 of the landing nipple. The interior bore 36 defines an internal passageway with an irregular interior profile. For example, the interior profile may include an upwardly facing shoulder 38 for landing the locking mandrel 30 and thereby positioning the wellbore tool 34. A relatively smooth sealing surface 40 is provided for establishing a seal with a seal mechanism 100 carried by the locking mandrel 30, and a plurality of slots 42 are provided for receiving retractable locking keys 44 or another lock defined on the locking mandrel 30. Each of the landing nipples 16 installed in the wellbore 12 (FIG. 1) may include similar features along an interior profile thereof. As the locking mandrel 30 is lowered through the landing nipples to a desired depth, the seal mechanism 100 may be damaged as the seal mechanism 100 encounters the features of the interior profiles.

The seal mechanism 100 may exhibit an outer diameter $OD_1$ that is smaller than an outer diameter $OD_2$ of an outer surface 48 of the locking mandrel 30, and smaller than an inner diameter of the sealing surface 40. In some embodiments, the inner diameter $ID_1$ of the sealing surfaces 40 may define the smallest diameter in the tubular string 14 (FIG. 1). Thus, the sealing surfaces 40 may limit access for the passage of tools therethrough and be subject to damage due to wireline cutting and other wellbore operations. The seal mechanism 100 may thus be recessed with respect to the outer surface 48 of the locking mandrel 30 and protected from damage while being lowered into the wellbore 12 (FIG. 1).

The seal mechanism 100 may include a single elongated gland or element constructed of a "swell metal," a "reactive metal" or an "expandable metal." As used herein, an "expandable metal" may be induced to chemically react in brines or other agents due to a chemical reaction with the water-based brine and create a seal at the interface of the seal mechanism 100 and the sealing surface 40 of the landing nipple 16. By "swell," "swelling," or "swellable" it is meant that the expandable metal increases its volume through a chemical reaction which is different from an elastomer that might expand through an absorption of a fluid. The expandable metals comprise a wide variety of metals and metal alloys and may swell by the formation of metal hydroxides. The expandable metals swell by undergoing metal chemical reactions in the presence of brines to form metal hydroxides. The metal hydroxide occupies more space than the base metal reactant as described in the Examples given below. "Expandable metals" may be distinguished from some types of materials such as elastomers that may absorb wellbore fluids to form a seal, without being induced to chemically react with the fluids.

Figure 3:
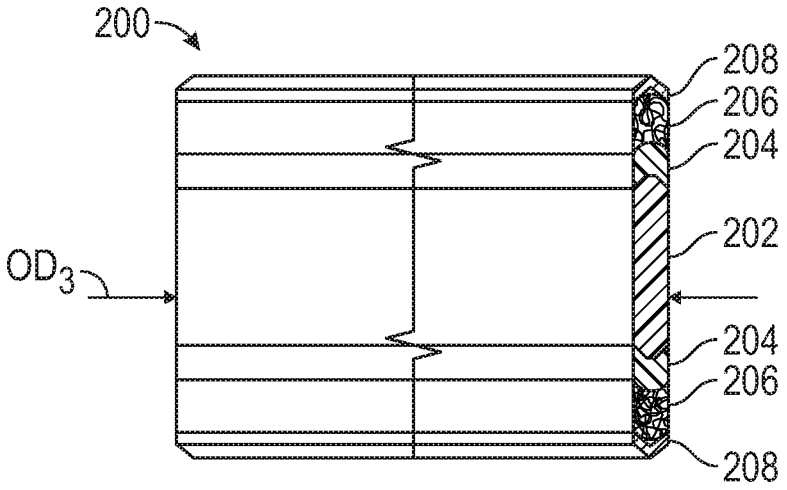
FIG. 3 is a partial, cross-sectional view of an alternate packing in accordance with embodiments of the present disclosure illustrating an expandable metal packing element installed in a packing stack.

Referring to FIG. 3, a seal mechanism 200 includes a center sealing element 202 and plurality of v-shaped or chevron-shaped packing rings 204, 206, 208. In some embodiments, the center sealing element 202 is an elongated gland constructed of an expandable metal, and in other embodiments (not shown), the center sealing element 202 may be constructed with a circular cross section or to match the geometry of an elastomeric o-ring. The geometry, number, and configuration of the packing rings 204, 206, 208 may be modified to suit any particular purpose. The packing rings 204, 206, 208 may be constructed of elastomeric, polymeric, metallic or other materials. For example, packing rings 204 adjacent the center sealing element 202 may be constructed of a tetrafluoroethylene-propylene polymer impregnated with glass fibers, packing rings 206 may be constructed of wire mesh and packing rings 208 at the outer ends of the seal mechanism 200 may be constructed of a flexible steel or aluminum. In other embodiments, one or more of the packing rings 204, 206, 208 may be constructed from different materials including any of the expandable metals described herein.

The center sealing element 202 may be constructed to define an outer diameter $OD_3$ that is a minimum diameter of the seal mechanism 200, and/or is smaller than any inner diameter $ID_1$ of a sealing surface 40 (FIG. 2). The sealing element 202 may pass through and into sealing surfaces 40 (FIG. 2) without making contact therewith, preventing damage to both the sealing element 202 and the sealing surface 40. Once in place in the correct sealing surface 40, the sealing element may be induced to swell to grow in outer diameter to fit the correct sealing surface 40 and expand into any surface defects in the sealing surface 40.

Under pressure, packing rings 204, 206, 208 may flex radially outwards to close any gap between locking mandrel 30 and the sealing surface 40, and may facilitate maintaining a seal in various scenarios and high-temperature and high-pressure conditions. For example, packing rings 204 adjacent the expandable metal sealing element 202 may exhibit a variable degree of rigidity depending on the temperatures or pressures in the wellbore. The wire mesh of packing rings 206 be readily compressed to block any extrusion gap between landing nipple 16 and locking mandrel 30. Wire mesh ring 93 will fill in ally scratches, marks or similar defects on the inner diameter lift of the sealing surface 40 (FIG. 2) and will more uniformly distribute sealing forces over a larger area of landing nipple 16. The packing rings 208 may be relatively rigid except at very high pressures and may be energized to provide a backup in extreme circumstances. The packing rings 204, 206, 208 may or may not be arranged in a symmetrical arrangement, and one or more of the packing rings 204, 206 208 may include an expandable metal material.

Figure 4A:
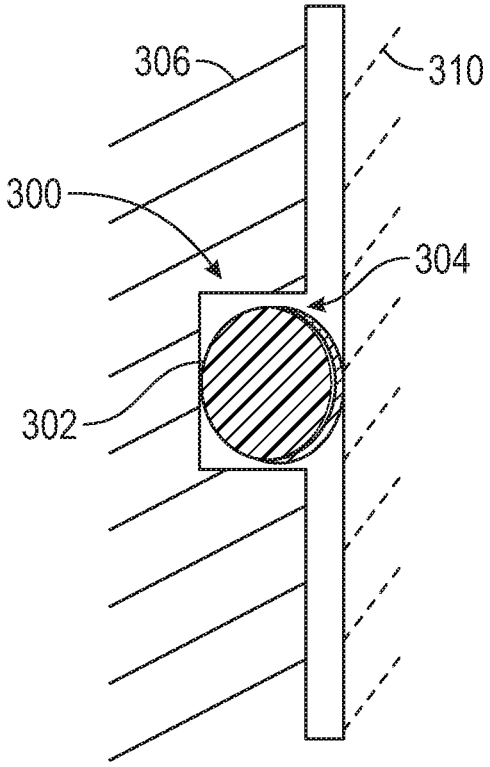
FIGS. 4A and 4B are schematic views of single-element, expandable metal seals installed between cooperating wellbore tubulars.

Referring now to FIG. 4A, a sealing mechanism 300 is illustrated including a single sealing element 302. The sealing element 302 is carried in a circumferential groove 304 defined in a first wellbore member 306 such as a locking mandrel. The sealing element 302 exhibits a circular cross-section that extends radially from the groove 304 even in an un-energized state. Thus, the sealing element 302 may interfere with a second wellbore member 310 such as a landing nipple. In some embodiments, the sealing element 302 may be constructed of an expandable metal and may be received entirely within the circumferential groove 304. The sealing element 302 may be a split ring or have a scarf cut to ease installation. The sealing element 302 may be mechanically deformed to fit within the groove such as through a swaging, stretching, or other plastic deformation process.

Figure 4B:
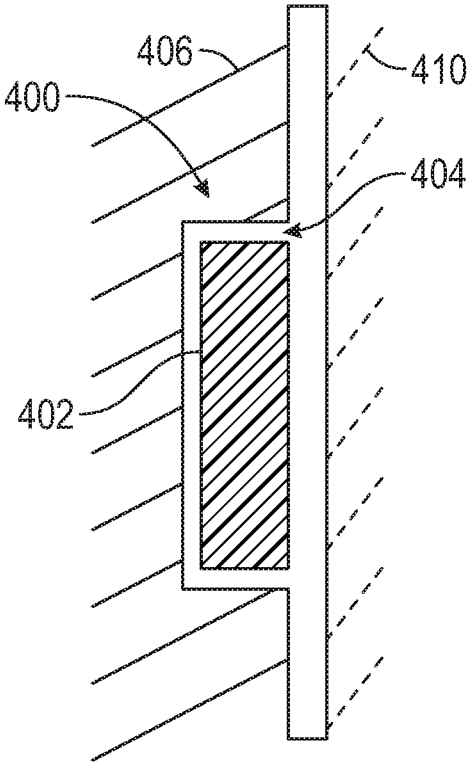

As illustrated in FIG. 4B, a sealing mechanism 400 includes a single sealing element 402 disposed entirely within a circumferential groove 404 defined in a first wellbore member 406. Thus, the sealing element 402 will not interfere with a second wellbore member 410 as the first wellbore member 406 moves past the second wellbore member 410. The sealing element 402 may be constructed of an expandable metal such that the sealing element 402 may be induced to swell to form a seal with the second wellbore member 410. The swelling will permit the sealing element 402 to accommodate any damage to the second wellbore member 410 and/or the sealing element 402 itself. The sealing element 402 is illustrated as an elongated gland, but may exhibit any cross section. An elongated cross section may enhance the sealing characteristics of the sealing mechanism 400.

Figure 5:
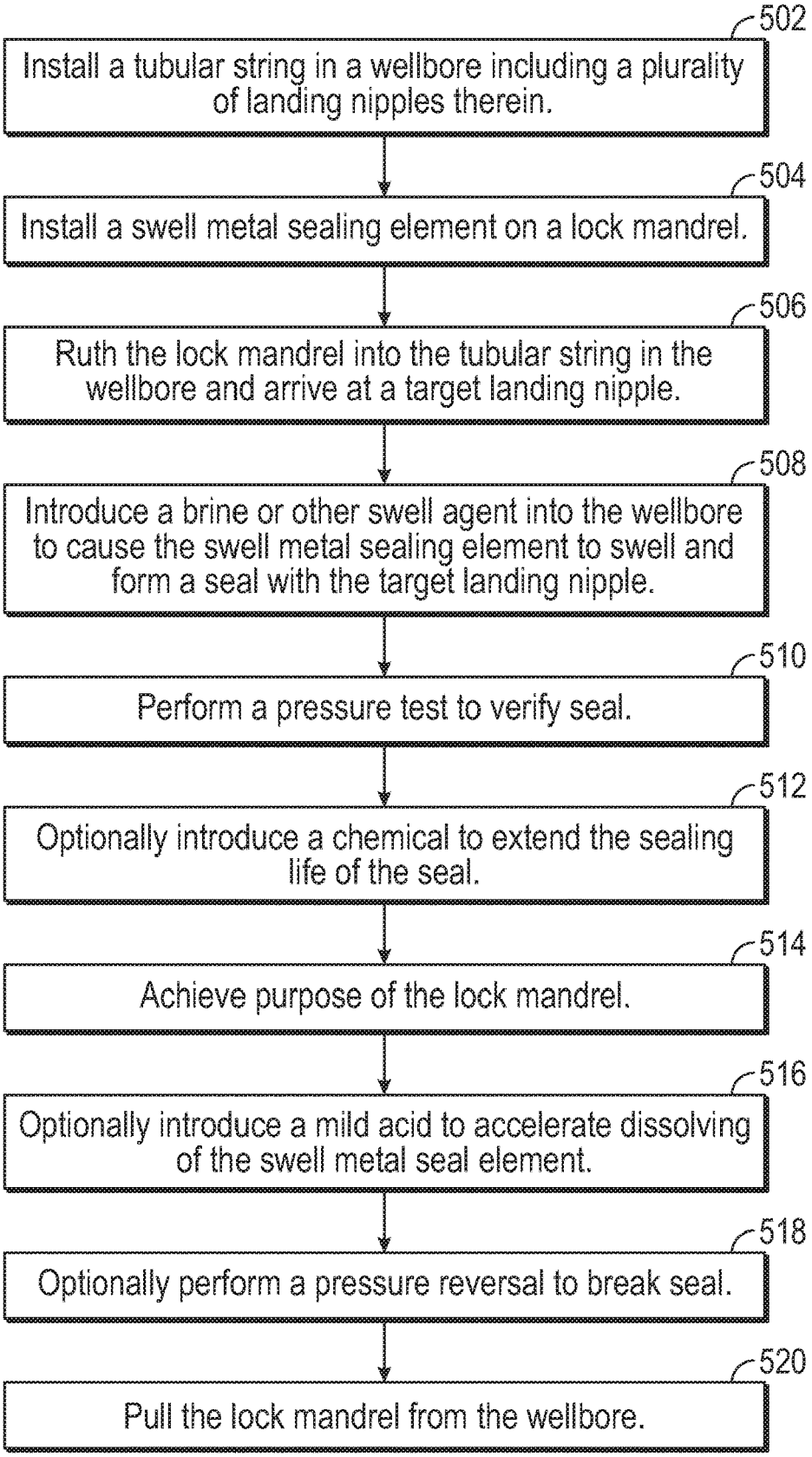
FIG. 5 is a flowchart illustrating an operational procedure for sealing between cooperating wellbore tubulars with swell-metal seals.

Referring now to FIG. 5, an operational procedure 500 is illustrated for employing an expandable metal sealing mechanism. Initially at step 502, a tubular string is installed in a wellbore with a plurality of landing nipples coupled therein. The landing nipples can be positioned at downhole locations where wellbore tools may be used to perform various wellbore operations. Next at step 504 an expandable metal sealing element may be installed on a locking mandrel, and a wellbore tool may be coupled to the lock mandrel. The expandable metal sealing element may be installed as a portion of a packing stack or may be installed as a single component on the locking mandrel. The packing stack or the single component sealing element may be recessed with respect to an outer diameter of the locking mandrel or may be smaller than a seal bore defined in the landing nipples. The locking mandrel may then be run into the tubular string (step 506) on a conveyance, and the sealing element may avoid contact with the landing nipples and may avoid frictional contact with the tubular string. The lock may mandrel may arrive at target landing nipple where the wellbore tool is to be employed.

At step 508 a brine or other swelling agent may be introduced in the wellbore, if it is not already present. After an initial time period, e.g., several hours or several days, the expandable metal sealing element will swell and form a seal with the target landing nipple and the wellbore tool may be locked into place. A pressure test may be performed to verify that an effective seal had been established (step 510), and optionally a chemical may be introduced to extend the life of the seal (Step 512). The intended purpose of the locking mandrel may be achieved (step 514), e.g., the wellbore tool may be operated in the wellbore. In some embodiments, the wellbore tool may include a valve or other equipment that may be employed for a number of months or years.

Once the intended purpose of the lock mandrel is achieved, a mild acid, e.g., citric acid, may be optionally introduced to the wellbore (step 516) to accelerate dissolving of the expandable metal seal element and/or a pressure reversal may be performed (518) to break the seal with the target landing nipple established by the expandable metal seal element. At step 520, the locking mandrel and wellbore tool may be pulled from the wellbore.

Examples

As indicated above, the expandable metals swell by undergoing chemical reactions in the presence of brines or other swelling agents to form metal hydroxides. The metal hydroxide occupies more space than the base metal reactant. For example, a mole of magnesium has a molar mass of 24 g/mol and a density of 1.74 g/cm3 which results in a volume of 13.8 cmVmol. Magnesium hydroxide has a molar mass of 60 g/mol and a density of 2.34 g/cm3 which results in a volume of 25.6 cmVmol. 25.6 cmVmol is 85% more volume than 13.8 cmVmol. As another example, a mole of calcium has a molar mass of 40 g/mol and a density of 1.54 g/cm3 which results in a volume of 26.0 cmVmol. Calcium hydroxide has a molar mass of 76 g/mol and a density of 2.21 g/cm3 which results in a volume of 34.4 cmVmol. 34.4 cmVmol is 32% more volume than 26.0 cmVmol. As yet another example, a mole of aluminum has a molar mass of 27 g/mol and a density of 2.7 g/cm3 which results in a volume of 10.0 cmVmol. Aluminum hydroxide has a molar mass of 63 g/mol and a density of 2.42 g/cm3 which results in a volume of 26 cmVmol. 26 cmVmol is 160% more volume than 10 cm/mol. The expandable metal comprises any metal or metal alloy that may undergo a chemical reaction to form a metal hydroxide of greater volume than the base metal or metal alloy reactant. This expansion in volume allows the expandable metal to form a seal at the interface of the expandable metal seal mechanism 100 and the sealing surface 40 or any adjacent surfaces.

Examples of suitable metals for the expandable metal include, but are not limited to, magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or any combination or thereof. Preferred metals include magnesium, calcium, and aluminum.

Examples of suitable metal alloys for the expandable metal include, but are not limited to, any alloys of magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, and erbium. Preferred metal alloys include, alloys of magnesium-zinc-zirconium or aluminum-nickel. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity or to control the formation of oxides.

In some examples, the metal alloy is also alloyed with a dopant metal that promotes corrosion or inhibits passivation and thus increased hydroxide formation. Examples of dopant metals include, but are not limited to, nickel, iron, copper, carbon, titanium, gallium, mercury, cobalt, iridium, gold, palladium, or any combination thereof.

In examples where the expandable metal comprises a metal alloy, the metal alloy may be produced from a solid solution process or a powder metallurgical process. The sealing mechanism 100 comprising the metal alloy may be formed either from the metal alloy production process or through subsequent processing of the metal alloy.

As used herein, the term "solid solution" refers to an alloy that is formed from a single melt where all of the components in the alloy (e.g., a magnesium alloy) are melted together in a casting. The casting can be subsequently extruded, wrought, hipped, or worked to form the desired shape for the sealing element of the expandable metal. Preferably, the alloying components are uniformly distributed throughout the metal alloy, although intra-granular inclusions may be present, without departing from the scope of the present disclosure. It is to be understood that some minor variations in the distribution of the alloying particles can occur, but that it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the expandable metal.

In some alternative examples, the expandable metal comprises an oxide. As an example, calcium oxide reacts with water in an energetic reaction to produce calcium hydroxide. 1 mole of calcium oxide occupies 9.5 cm3 whereas 1 mole of calcium hydroxide occupies 34.4 cm3 which is a 260% volumetric expansion. Examples of metal oxides include oxides of any metals disclosed herein, including, but not limited to, magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or any combination thereof.

It is to be understood, that the selected expandable metal is to be selected such that the formed sealing element does not degrade into the brine. As such, the use of metals or metal alloys for the expandable metal that form relatively water-insoluble products may be preferred. For example, magnesium hydroxide and calcium hydroxide have low solubility in water. Alternatively, or in addition to, the sealing element may be positioned in the downhole tool such that degradation into the brine is constrained due to the geometry of the area in which the sealing element is disposed and thus resulting in reduced exposure of the sealing element. For example, the volume of the area in which the sealing element is disposed is less than the expansion volume of the expandable metal. In some examples, the volume of the area is less than as much as 50% of the expansion volume. Alternatively, the volume of the area in which the sealing element may be disposed may be less than 90% of the expansion volume, less than 80% of the expansion volume, less than 70% of the expansion volume, or less than 60% of the expansion volume.

In some examples, the metal chemical reaction may comprise an intermediate step where the metal hydroxides are small particles. When confined, these small particles may lock together to create the seal. Thus, there may be an intermediate step where the expandable metal forms a series of fine particles between the steps of being solid metal and forming a seal.

In some alternative examples, the expandable metal is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluroelastomers, ethylene-based rubber, and PEEK. In some embodiments, the dispersed expandable metal may be cuttings obtained from a machining process.

In some examples, the metal hydroxide formed from the expandable metal may be dehydrated under sufficient swelling pressure. For example, if the metal hydroxide resists movement from additional hydroxide formation, elevated pressure may be created which may dehydrate the metal hydroxide in certain examples. This dehydration may result in the formation of the metal oxide from the expandable metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the expandable metal may allow the expandable metal to form additional metal hydroxide and continue to swell.

The sealing elements may be used to form a seal at the interface of the sealing element and an adjacent rough surface finish component. A "rough surface finish" as used herein, is a surface finish that is not even or consistent at the area where the sealing is to occur. A rough surface finish comprises a surface having any type of indentation or projection, for example, surfaces comprising gashes, gaps, pocks, pits, holes, divots, and the like. Additionally, components produced by additive manufacturing, for example 3-D printed components, may be used with the sealing elements to form seals. Additive manufactured components may not involve precision machining and may, in some examples, comprise a rough surface finish. The sealing elements may expand to fill and seal the imperfect areas of the rough surface finish allowing a seal to be formed between surfaces that typically cannot be sealed with elastomeric sealing elements. Further, the rough surface finish components may also be less expensive than comparable components having precision-machined finishes. Advantageously, the sealing elements may also be used to form a seal at the interface of the sealing element and an irregular surface component. For example, components manufactured in segments or split with scarf joints, butt joints, splice joints, etc. may be sealed, and the chemical reaction of the expandable metals may be used to close the gaps in the irregular surface. As such, the expandable metal sealing elements may be viable sealing options for difficult to seal surfaces.

As described above, the sealing elements are produced from expandable metals and as such, are non-elastomeric materials except for the specific examples that further comprise an elastomeric binder for the expandable metals. As non-elastomeric materials, the sealing elements do not possess elasticity and therefore the sealing elements irreversibly swell when contacted with a brine. The sealing elements do not return to their original size or shape even after the brine is removed from contact. In examples comprising an elastomeric binder, the elastomeric binder may return to its original size or shape; however, any expandable metal dispersed therein would not.

The brine may be saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%. In said examples, use of elastomeric sealing elements may be impacted. Advantageously, the expandable metal sealing elements of the present disclosure are not impacted by contact with high-salinity brines. One of ordinary skill in the art, with the benefit of this disclosure, should be readily able to select a brine for a chosen application.

The sealing elements may be used in high-temperature formations, for example, in formations with zones having temperatures equal to or exceeding 350° F. In these high-temperature formations, use of elastomeric sealing elements may be impacted. Advantageously, the expandable metal sealing elements of the present disclosure are not impacted by use in high-temperature formations. In some examples, the sealing elements of the present disclosure may be used in high-temperature formations and with high-salinity brines. In a specific example, an expandable metal sealing element may be used to form a seal for a downhole tool by swelling after contact with a brine having a salinity of 10% or greater and also while being disposed in a wellbore zone having a temperature equal to or exceeding 350° F.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, a wellbore system includes a tubular string including a at least one landing nipple therein, the at least one landing nipple defining a sealing surface with an internal passageway extending therethrough. The system includes a locking mandrel including an elongated body defines an outer surface, the locking mandrel including a lock for securing the elongated body within the internal passageway extending through the landing, and a sealing mechanism carried by the locking mandrel and including a sealing element constructed of an expandable metal, the expandable metal reactive to form metal hydroxides in the presence of a water-based fluid.

In some embodiments, the sealing element is disposed within a circumferential groove defined in the elongated body of the locking mandrel, and wherein the sealing element is radially recessed with respect to the outer surface of the elongated body. The sealing element may be reactive in a brine solution to form the metal hydroxides to thereby increase in volume and establish sealing contact with the sealing surface of the landing nipple. The sealing element may be an elongated gland.

In one or more embodiments, the sealing mechanism includes a plurality of packing rings disposed adjacent the sealing element. The sealing element may include a metal selected from the group consisting of magnesium, calcium, and aluminum. The wellbore system may further include a wellbore tool coupled to an end of the locking mandrel, in some embodiments. The at least one landing nipple in some embodiments includes a plurality of nipples are arranged in a selective bore completion arrangement.

According to another aspect, a method of deploying downhole tools in a wellbore includes (a) installing a at least one target landing nipple defining a sealing surface in the wellbore coupled to a tubular string, (b) running a locking mandrel into the tubular suing to the sealing surface (c) exposing an expandable metal sealing element carried by the lock mandrel to a water-based fluid in the tubular string and (d) establishing a seal between the expandable metal seal sealing element and the sealing surface by increasing the volume of the expandable metal sealing element by a chemical reaction with the water-based fluid.

In some embodiments, the method further includes maintaining a radial separation between the sealing element and landing nipples coupled above the target landing nipple while running the locking mandrel into the tubular string. The method may further include radially recessing sealing element with respect to an outer surface of the locking mandrel.

In one or more embodiments, introducing the water-based fluid further comprises introducing a brine solution into the wellbore. The method may further include installing the sealing element between a plurality of packing rings on the locking mandrel, and flexing the packing rings to contact the sealing surface of the target landing nipple. In some embodiments, the method may further include dissolving the sealing element in the wellbore to break the seal established with the sealing surface of the target landing nipple. Dissolving the sealing element in the wellbore may further include introducing an acid into the wellbore to accelerate the dissolving.

According to another aspect, an apparatus for use in a wellbore includes an elongated mandrel body defining an outer surface, a lock coupled to the mandrel body for securing the elongated body within an internal passageway of a landing nipple and a sealing mechanism coupled to the mandrel body and including a sealing element constructed of an expandable metal material reactive to form metal hydroxides in the presence of a water-based fluid.

In one or more embodiments, the sealing element is radially recessed with respect to the outer surface of the mandrel body. The sealing element may be constructed as an elongated gland, and the sealing mechanism may consist of the single sealing element. In some embodiments, the sealing mechanism includes the sealing element and plurality of chevron-shaped packing rings. The apparatus may further include the landing nipple receiving the elongated mandrel therein, the landing nipple including a profile cooperating with the lock to selectively secure the elongated mandrel within the internal passageway and a sealing surface defined in the internal passageway aligned with the sealing element when the elongated mandrel is secured within the internal passageway.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A wellbore system, comprising:

a tubular string including a at least one landing nipple therein, the at least one landing nipple defining a sealing surface with an internal passageway extending therethrough;

a locking mandrel including an elongated body defining an outer surface, the locking mandrel including a lock for securing the elongated body within the internal passageway extending through a landing;

a sealing mechanism carried by the locking mandrel and including a sealing element constructed of an expandable metal, the expandable metal reactive to form metal hydroxides in the presence of a water-based fluid; and a radial separation between the sealing element constructed of the expandable metal and the at least one landing nipple before the chemical reaction with the water-based fluid.

2. The wellbore system according to claim 1, wherein the sealing element is disposed within a circumferential groove defined in the elongated body of the locking mandrel, and wherein the sealing element is radially recessed with respect to the outer surface of the elongated body.

3. The wellbore system according to claim 2, wherein the sealing element is reactive in a brine solution to form the metal hydroxides to thereby increase in volume and establish sealing contact with the sealing surface of the landing nipple.

4. The wellbore system according to claim 3, wherein the sealing element is an elongated gland.

5. The wellbore system according to claim 1, wherein the sealing mechanism includes a plurality of packing rings disposed adjacent the sealing element.

6. The wellbore system according to claim 1, wherein the sealing element includes a metal selected from the group consisting of magnesium, calcium, and aluminum.

7. The wellbore system according to claim 1, further comprising a wellbore tool coupled to an end of the locking mandrel.

8. The wellbore system according to claim 1, wherein the at least one landing nipple includes a plurality of nipples are arranged in a selective bore completion arrangement.

9. A method of deploying downhole tools in a wellbore, the method comprising:

installing a at least one target landing nipple defining a sealing surface in the wellbore coupled to a tubular string;

running a locking mandrel into the tubular string to the sealing surface;

maintaining a radial separation between an expandable metal sealing element and the at least one target landing nipple;

exposing the expandable metal sealing element carried by the lock mandrel to a water-based fluid in the tubular string; and establishing a seal between the expandable metal seal sealing element and the sealing surface by increasing the volume of the expandable metal sealing element by a chemical reaction with the water-based fluid.

10. The method according to claim 9, further comprising maintaining a radial separation between the expandable metal sealing element and landing nipples coupled above the target landing nipple while running the locking mandrel into the tubular string before the chemical reaction with the water-based fluid.

11. The method according to claim 10, further comprising radially recessing sealing element with respect to an outer surface of the locking mandrel.

12. The method according to claim 9, wherein introducing the water-based fluid further comprises introducing a brine solution into the wellbore.

13. The method according to claim 9, further comprising installing the sealing element between a plurality of packing rings on the locking mandrel, and flexing the packing rings to contact the sealing surface of the target landing nipple.

14. The method according to claim 9, further comprising dissolving the sealing element in the wellbore to break the seal established with the sealing surface of the target landing nipple.

15. The method according to claim 14, wherein dissolving the sealing element in the wellbore further comprises introducing an acid into the wellbore to accelerate the dissolving.

16. An apparatus for use in a wellbore, the apparatus comprising:

an elongated mandrel body defining an outer surface;

a lock coupled to the mandrel body for securing the elongated body within an internal passageway of a landing nipple; and a sealing mechanism coupled to the mandrel body and including a sealing element constructed of an expandable metal material reactive to form metal hydroxides in the presence of a water-based fluid; wherein the sealing element constructed of the expandable metal material is radially separated from the landing nipple before the chemical reaction with the water-based fluid.

17. The apparatus according to claim 16, wherein the sealing element is radially recessed with respect to the outer surface of the mandrel body.

18. The apparatus according to claim 16, wherein the sealing element is constructed as an elongated gland, and wherein the sealing mechanism consists of the single sealing element.

19. The apparatus according to claim 16, wherein the sealing mechanism comprises the sealing element and plurality of chevron-shaped packing rings.

20. The apparatus according to claim 16, further comprising the landing nipple receiving the elongated mandrel therein, the landing nipple including a profile cooperating with the lock to selectively secure the elongated mandrel within the internal passageway and a sealing surface defined in the internal passageway aligned with the sealing element when the elongated mandrel is secured within the internal passageway.

* * * * *